US006948346B2

(12) United States Patent
Pawelski

(10) Patent No.: US 6,948,346 B2
(45) Date of Patent: Sep. 27, 2005

(54) METHOD FOR SPECIFICALLY ADJUSTING THE SURFACE STRUCTURE OF ROLLING STOCK DURING COLD ROLLING IN SKIN PASS MILLS

(75) Inventor: Hartmut Pawelski, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 29 days.

(21) Appl. No.: 10/469,466

(22) PCT Filed: Feb. 28, 2002

(86) PCT No.: PCT/EP02/02118

§ 371 (c)(1),
(2), (4) Date: Aug. 28, 2003

(87) PCT Pub. No.: WO02/070160

PCT Pub. Date: Sep. 12, 2002

(65) Prior Publication Data

US 2004/0069381 A1 Apr. 15, 2004

(30) Foreign Application Priority Data

Mar. 3, 2001 (DE) ..... 101 10 323

(51) Int. Cl.[7] ..... B21B 37/24

(52) U.S. Cl. ..... 72/7.1; 72/7.4; 72/11.1; 72/41; 72/366.2

(58) Field of Search ..... 72/199, 236, 365.2, 72/366.2, 7.1, 7.4, 8.3, 8.6, 10.4, 11.1, 11.4, 9.1, 11.7, 12.3, 41, 42, 43; 700/150, 152, 154, 155

(56) References Cited

U.S. PATENT DOCUMENTS 4,964,289 A * 10/1990 Dean ..... 72/12.2
5,250,364 A * 10/1993 Hector et al. ..... 428/687
5,279,141 A * 1/1994 Kenmochi et al. ..... 72/39
5,537,851 A * 7/1996 Sheu et al. ..... 72/366.2
5,555,756 A * 9/1996 Fischer et al. ..... 72/41
6,089,069 A * 7/2000 Seidel et al. ..... 72/236
6,240,757 B1 * 6/2001 Brustle et al. ..... 72/9.2
6,526,328 B1 * 2/2003 Maguin et al. ..... 700/148

FOREIGN PATENT DOCUMENTS

DE 3026229 2/1981
DE 3536666 7/1986
JP 2000-140917 * 5/2000 ..... B21B/37/00

OTHER PUBLICATIONS

Patent Abstracts of Japan, vol. 017, No. 005 (M–1349), Jan. 6, 1993 & JP 04 238616 A (Kawasaki Steel Corp), Aug. 26, 1992.

* cited by examiner

*Primary Examiner*—Ed Tolan
(74) *Attorney, Agent, or Firm*—Friedrich Kueffner

(57) ABSTRACT

The invention relates to a method for specifically adjusting the surface structure of rolling stock (3) during cold rolling in skin pass mills. The aim of the invention is to partially transfer the surface structure of the working roll (2) onto the rolling stock (3). To this end, the change of roughness of the rolling stock (3) in the rolling process of a single- or multiple-stand, preferably two-stand skin pass mill is calculated in an optimization calculation in which the rolling parameters are varied according to the mill capacity using a tribological model that mathematically describes the friction conditions in the roll gap (1). The results obtained are then used to readjust at least a part of the rolling parameters used for calculation.

3 Claims, 2 Drawing Sheets

METHOD FOR SPECIFICALLY ADJUSTING THE SURFACE STRUCTURE OF ROLLING STOCK DURING COLD ROLLING IN SKIN PASS MILLS

The present application is a Section 371 National Phase of International application PCT/EP02/02118 filed Feb. 28, 2002, which claims priority from German application 101 10 323.9 filed Mar. 3, 2001.

The invention concerns a method for systematically adjusting the surface structure of rolling stock during cold rerolling in temper rolling mills, in which there is a partial transfer of the surface structure of the working rolls to the rolling stock.

The preceding hot working or cold working and subsequent annealing produce a lack of flatness in the rolling stock and pronounced yield stresses, which can lead to the formation of stretcher strains during subsequent further processing. To improve flatness and to prevent the formation of stretcher strains, the rolling stock is subjected to light cold working (cold rerolling) with a low degree of deformation of only up to 3%. This cold working additionally increases the surface smoothness of the rolling stock, accompanied by an intended partial transfer of the surface structure of the working rolls to the rolling stock to produce a specific surface roughness. This intended surface roughness or surface structure of the rolling stock helps avoid, e.g., problems with deep drawing (abrasive and adhesive wear by metallic contact and uncontrolled creep) and inadequate paintability.

The transfer of the surface structure of the working rolls to the rolling stock is critically affected by a large number of rolling parameters and by the thickness of the rolling stock, the initial roughness of the rolling stock, the roughness of the working rolls, the rerolling speed, and the rerolling temperature.

According to the results of a study by Kurt Steinhoff ("Study on the Rerolling of Metal-Coated Sheet", Umformtechnische Schriften, Vol. 47, Verlag Stahl-Eisen), it was found to be an advantage in carrying out the rerolling that improved transfer can be achieved by rerolling in two passes. In this regard, the distribution of the degrees of deformation between the individual passes is important, since the pronounced leveling effect achieved with only low degrees of deformation in the first rerolling pass leads to favorable transfer conditions in the second pass.

Proceeding from this well-known state of the art, which is characterized by exacting requirements on the mechanical properties of the stock to be rolled, combined with exacting requirements on the surface quality (especially homogeneity over the width and length of the rolling stock), new concepts of cold rerolling were developed, which led, in particular, to the concept of the two-stand temper rolling mill. Various parameters are available in the type of equipment of this new temper rolling technology to satisfy the requirements for adjustment to a constant degree of temper rolling with constant surface quality, e.g., at varying speed (start-up and slow-down phase). In this type of train, the distribution of the individual degrees of temper rolling, the tension between stands, to a certain extent the reel tension, and the resulting rolling force, among other parameters, are available to keep the strip roughness that is produced constant.

The object of the invention is to specify a method by which the individual parameters relevant to rolling can be coordinated, so that it is possible to predict the coefficient of friction in the roll gap and the change in the surface of the rolling stock produced by the rerolling (temper rolling), and so that it is possible, on the basis of these predictions, to adjust the rolling parameters in advance.

This object is achieved for a multiple-stand temper rolling mill with the characterizing features of claim 1 by calculating the change in roughness of the rolling stock in the rolling process of a single-stand or multiple-stand, preferably two-stand, temper rolling mill with an optimization calculation, in which the rolling parameters are varied according to the available mill capacity, with the use of a tribological model that mathematically describes the friction conditions in the roll gap, and then using the results obtained in this way to preset at least some of the rolling parameters used in the calculation.

To perform the optimization calculation, it is convenient to construct the tribological model from interlinked partial models, so that various parameters are first calculated separately from one another, and then the results that are obtained are combined. For example, the coefficient of friction $\mu$ and the ratio T of bearing contact area to total area can be calculated, for example, as a function of the roll gap coordinates, and used to calculate the rolling pressure "ground" (pressure distribution in the roll gap). Parameters relevant to rolling are incorporated in these calculations and varied for optimization, and especially the parameters available for a two-stand temper rolling mill must be taken into consideration:

distribution of the individual degrees of temper rolling;

tension between stands;

reel tension;

resultant rolling force; and rolling speed.

The primary objective is to ensure that the calculation is performed in such a way that, at all rolling speeds, the rolling stock has a constant roughness after the last stand. A second objective is to ensure that the calculation is performed in such a way that the overall degree of temper rolling (sum of the degrees of temper rolling of the individual stands) is held constant.

To illustrate the principle of the invention, several graphic relationships are represented below.

FIG. 2 shows the behavior of the coefficient of friction $\mu$ in the roll gap.

FIG. 3 shows the behavior of the ratio T of bearing contact area to total area in the roll gap.

FIG. 4 shows the behavior of the pressure P normal to the surface in the roll gap.

FIGS. 1 to 4 show the typical interplay of the partial models that are necessary for a complete tribological model of the roll gap.

Figure 1:
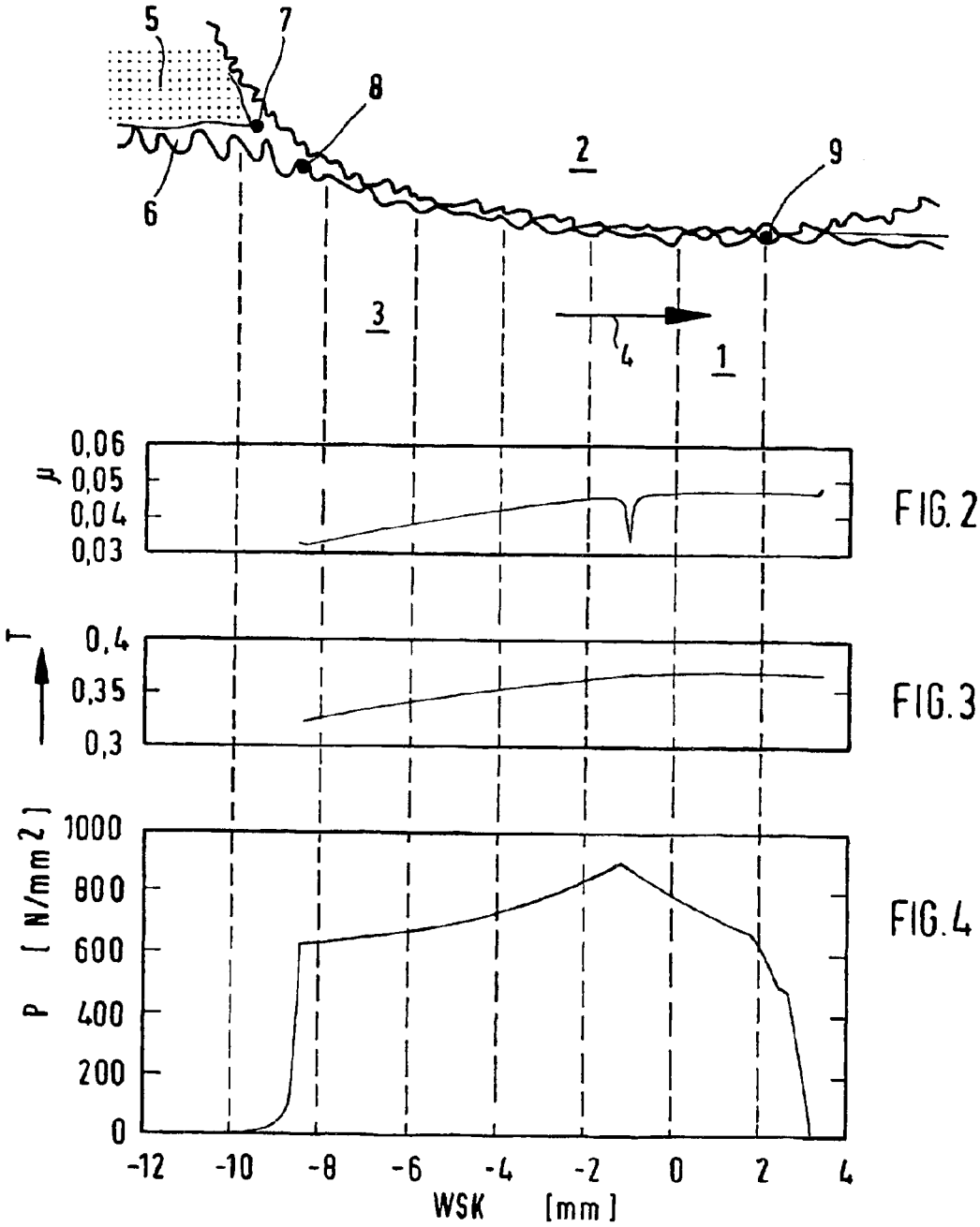
FIG. 1 shows a schematic vertical partial section through a roll gap.

FIG. 1 shows a vertical partial section through a roll gap 1, in which the rolled strip 3 is located between the upper working roll 2 and the lower working roll (not shown). In the drawing in FIG. 1, the roll runs in the direction indicated by the arrow 4, from left to right. To assist the rolling process, the surfaces of the working rolls 2 and the rolled strip 3 are wetted with an emulsion 5, which becomes enriched with oil in the wedge-shaped region between the rolled strip 3 and the working roll 2 due to the increase in pressure. During the rolling process, this oil-enriched emulsion 6 is entrained through the roll gap 1 from left to right along with the rolled strip 3.

When rolling oil or wet temper rolling lubricant is used, this enrichment process does not occur. In this case, the lubricant is drawn as such through the roll gap.

To gain a better understanding of the following discussion, the relevant parameters are plotted as a function of the roll gap coordinate WSK, which ranges from a value of −10 mm (run-in region) through ±0 mm to +4 mm (region of separation of the working roll and rolled strip).

FIGS. 2 to 4, which show the behavior of the coefficient of friction $\mu$ (FIG. 2), the behavior of the ratio T of bearing contact area to total area of the surface roughness (FIG. 3), and the behavior of the pressure P normal to the surface in the roll gap (FIG. 4), each as a function of this roll gap coordinate WSK, are arranged beneath the schematic representation of the roll gap of FIG. 1 in such a way that the roll gap coordinates WSK are aligned.

By showing FIGS. 1 to 4 together in this way, it is possible to identify the following features at the following roll gap coordinates WSK:

At the roll run-in, a wedge-shaped run-in region is formed, which causes a pressure increase 7 of the lubricant (oil-enriched suspensions 6) due to hydrodynamic effects (starting at about roll gap coordinate WSK −10 mm to about −8 mm), which lasts until level yield stress minus back-tension stress is reached, and the strip becomes plastic. Using the thickness of the layer of lubricant film drawn in at this point 8, the ratio T of bearing contact area to total area (see FIG. 3), i.e., the ratio of the microscopic contact surface of the roughness peaks of the strip 3 and the working roll 2 to the macroscopic contact area, can be calculated at the run-in region in a partial model. This partial model describes the development of the surface roughness (starting at about point 8 at a roll gap coordinate of about −8 mm to about point 9 at a roll gap coordinate of about +2 mm) and the associated increase in the ratio T of bearing contact area to total area during passage through the roll gap.

Using the ratio T of bearing contact area to total area as a function of the roll gap coordinate WSK (see FIG. 3), the associated coefficient of friction $\mu$ as a function of the roll gap coordinate WSK (see FIG. 2) can be calculated, and then, using the elastic-plastic strip theory, the rolling pressure distribution (see development of the pressure P normal to the surface, FIG. 4) can be calculated.

In strip theory, the rolling stock present in the roll gap is divided into vertical strips. It is assumed that the rolling pressure P acting on this type of strip passes unchanged through the strip in the vertical direction. Since the thickness of the steel strip in cold rolling is small relative to the length of the roll gap, this assumption is justified. By adding in the static equilibrium at the strip, the change in the rolling pressure with changing roll gap coordinate can be derived as a function of the local friction situation and the local strength of the material. The model used here was expanded by taking into account the elastic-plastic material behavior and the elastic flattening of the working rolls as a function of the rolling pressure distribution. This is necessary especially with respect to temper rolling applications.

A tribological model of this type will never be able to predict the friction exactly; an adaptation will continue to be necessary. Nevertheless, the reliance on physical basic models has the advantage that a change in the influencing variables also elicits a physically meaningful response of the model. In this way, extrapolation to nonadapted combinations of parameters is possible to a certain extent.

FIGS. 5 to 8 show an example of the use of this type of mathematical tribological model with the results obtained for a calculation performed for the example of a two-stand temper rolling mill.

The adjustments of this calculation example were performed as a function of the rolling speed v in such a way that the strip has a constant roughness after stand 2 at all speeds. At the same time, the total degree of temper rolling (sum of the degrees D of temper rolling of stand 1 (G1) and stand 2 (G2)) was held constant.

Figure 5:
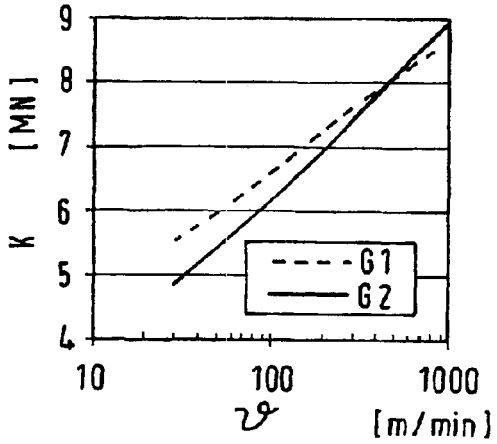
FIG. 5 shows the rolling force K as a function of the rolling speed v.
Figure 6:
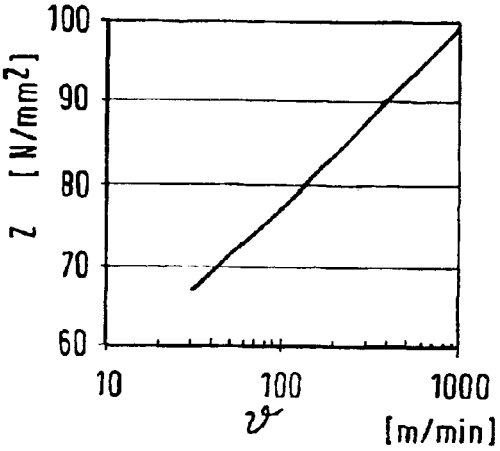
FIG. 6 shows the tension Z between the stands as a function of the rolling speed v.
Figure 7:
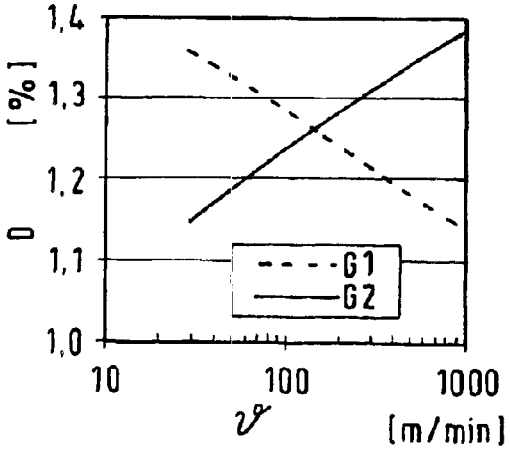
FIG. 7 shows the degree of temper rolling D as a function of the rolling speed v.
Figure 8:
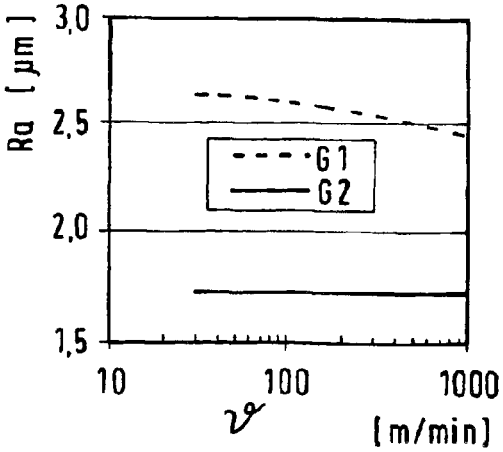
FIG. 8 shows the strip roughness Ra as a function of the rolling speed v.

The strip roughness values Ra plotted in FIG. 8 are obtained on the basis of the degrees D of temper rolling in the two rolling stands G1, G2 (see FIG. 7), the tension Z between the stands (see FIG. 6), and the resultant rolling forces K (see FIG. 5). The results that are obtained can then be drawn upon to preset the temper rolling process.

What is claimed is:

1. Method for systematically adjusting surface structure of rolling stock during cold rerolling in temper rolling mills, in which there is a partial transfer of the surface structure of the working rolls (2) to the rolling stock (3), wherein a change in roughness of the rolling stock (3) in the rolling process of a single-stand or multiple-stand, preferably two-stand, temper rolling mill is calculated with an optimization calculation, in which rolling parameters are varied according to an available mill capacity, with the use of a tribological model that mathematically describes friction conditions in the roll gap (1), and results obtained in this way are used to preset at least some of the rolling parameters used in the calculation with target values, wherein the calculation of the tribological model is performed in such a way that the rolling stock (3) has a constant roughness after the last stand at all rolling speeds (v) (calculation of the rolling parameters as a function of the rolling speed v) and the overall degree of temper rolling (sum of the degrees D of temper rolling of the individual stands) is held constant.

2. Method in accordance with claim 1, wherein the tribological model comprises interlinked partial models, by which the following calculations, are performed:

linking of the ratio (T) of bearing contact area to total area to the coefficient of friction (m) (friction model);

increase in the ratio (T) of bearing contact area to total area during passage through the roll gap (1)—behavior of the surface roughness (Ra) as a function of the roll gap coordinate (WSK)

calculation of the rolling pressure distribution (behavior of the pressure P normal to the surface) as a function of the roll gap coordinate (WSK).

3. Method in accordance with claim 2, wherein, to adjust a constant degree (D) of temper rolling at constant surface quality (constant strip roughness Ra), the following rolling parameters are taken into account in the mathematical tribological model to calculate the presettings:

distribution of the individual degrees (D) of temper rolling;

tension (Z) between stands;

reel tension;

resultant rolling force (K); and rolling speed (start-up and slow-down phase) (v).

* * * * *